US005486270A

United States Patent [19]

Schiel

[11] Patent Number: 5,486,270

[45] Date of Patent: Jan. 23, 1996

[54] ANGULARLY ADJUSTABLE DRAINAGE FOIL FOR PAPER MACHINES

[75] Inventor: Christian Schiel, Heidenheim, Germany

[73] Assignee: J.M. Voith GmbH, Heidenheim, Germany

[21] Appl. No.: 205,575

[22] Filed: Mar. 3, 1994

[30] Foreign Application Priority Data

Mar. 3, 1993 [DE] Germany ..... 43 06 503.1

[51] Int. Cl.[6] ..... D21F 1/54

[52] U.S. Cl. ..... 162/352; 162/374

[58] Field of Search ..... 162/352, 374

[56] References Cited

U.S. PATENT DOCUMENTS

| | | | |
|---|---|---|---|
| 4,559,105 | 12/1985 | Sennett et al. | 162/352 |
| 4,865,692 | 9/1989 | Kade et al. | 162/352 |
| 5,129,992 | 7/1992 | Schiel et al. | 162/352 |
| 5,169,500 | 12/1992 | Mejdell | 162/352 |
| 5,262,009 | 11/1993 | Schiel | 162/352 |

FOREIGN PATENT DOCUMENTS

| | | |
|---|---|---|
| 2432577 | 3/1975 | Germany . |
| 9105328 | 4/1991 | Germany . |
| 4009627 | 10/1991 | Germany . |

*Primary Examiner*—Karen M. Hastings
*Attorney, Agent, or Firm*—Baker & Daniels

[57] ABSTRACT

An angularly adjustable drainage foil for paper machines. A facultatively two-part support structure extends across the machine width, and comprises a first beam and a backing shape mounted on it. A facultatively two-part cover strip extends across the machine width, and consists of an upper, wear-resistant foil strip and a support shape supporting the foil strip. A moving device effects a relative longitudinal motion of the cover strip and support structure. As the cover strip and support structure are moved relative to each other, the angle of incidence α between drainage surface **12*b*** and the wire surface running over it is influenced. Provided between the underside of the cover strip and the top side of the support structure are compression means which force the claws of the cover strip on the respective backing surfaces of the support structure. The cover strip is so designed that it grips at least one-sidedly and claw-like the appropriately designed backing shape at least partly respectively engages it.

9 Claims, 2 Drawing Sheets

ANGULARLY ADJUSTABLE DRAINAGE FOIL FOR PAPER MACHINES

BACKGROUND OF THE INVENTION

The invention concerns an angularly adjustable drainage foil for paper machines. Concerned here are shallow strips which contact the wire in the machine and normally possess in their front section a scraper type front edge. These front edges serve the removal or stripping of water from the wire. In operation, a small angle of inclination is set between the surface of the wire and the surface of the foil, which creates, when viewed in the direction of travel of the belt, a diverging angle between wire and foil which generates a vacuum on the wire and, depending on the size of the angle, causes a more or less pronounced water drainage.

A system of this general type is known, e.g., from the utility model G 91 05 328. Presented here is a drainage foil whose angle is set such that the support structure of the drainage foil is hinged, on its front edge by means of a joint, to a stable base structure which extends across the machine width, while the other side features pins adapted to engage a slot, said slots extending at a small angle of elevation along a rod which extends through the carrier. The carrier is then raised or lowered on the one side by a longitudinal motion of the rod and through the intermediary of the pins, thereby causing an adjustment of the angle of incidence between wire surface and foil surface. Additional expensive measures are provided here to avoid mechanical backlash. A disadvantage of this arrangement is the high design and production engineering expense, which expresses itself in high manufacturing costs. A further disadvantage is that adjusting the angle causes the height of the edge to change.

The problem underlying the present invention is to provide an angularly adjustable drainage foil for paper machines where a quick and precise setting of the foil angle is possible in the range of zero to several degrees, with great significance being attached to a solution that is simple and in view of manufacturing engineering easy to accomplish, and thus also a low-cost solution. The height of the edge or surface supporting the wire should preferably not change, or change only a little.

SUMMARY OF THE INVENTION

This problem is solved by the inventive features of the present invention. The present invention, in one form thereof, comprises an angularly adjustable drainage foil for a revolving dewatering wire of a paper machine. A facultatively two-part support structure extends across the machine width. This support structure is comprised of a first beam and a backing shape mounted on the first beam. A facultatively two-part cover strip also extends across the machine width. The two-part cover strip consists of an upper, wear-resistant foil strip and a support shape supporting the foil strip. A moving device is provided which effects a relative longitudinal motion between the cover strip and the support structure. Means are provided which, as cover strip and support structure are moved relative to each other, influence the angle of incidence between the drainage surface and the wire surface running over it. Provided between the underside of the cover strip and the top side of the support structure are compression means which force the claws of the cover strip on the respective backing surfaces of the support structure. The cover strip is so designed that it grips at least one-sidedly and claw-like the appropriately designed backing shape and at least partly engages it.

In another form thereof, the present invention comprises an angularly adjustable drainage foil for a revolving dewatering wire of a paper machine. A facultatively two-part support structure extending across the machine width is provided, which support structure consists of a first beam and a backing shape fastened to it. A facultatively two-part cover strip extending across the machine width is provided, which cover strip consists of an upper, wear-resistant foil strip and a support shape supporting said foil strip. A moving device effects a relative longitudinal motion between the cover strip and support structure. Means are provided which, as the cover strip is moved relative to the support structure, influence the angle of incidence between the drainage surface and the wire surface running over it. The cover strip is designed so that it can be moved on both sides longitudinally relative to the support structure by slot-and-cam combinations.

BRIEF DESCRIPTION OF THE DRAWINGS

The invention will be more fully explained with the aid of the drawings.

DETAILED DESCRIPTION OF THE PREFERRED EMBODIMENTS

Figure 1:
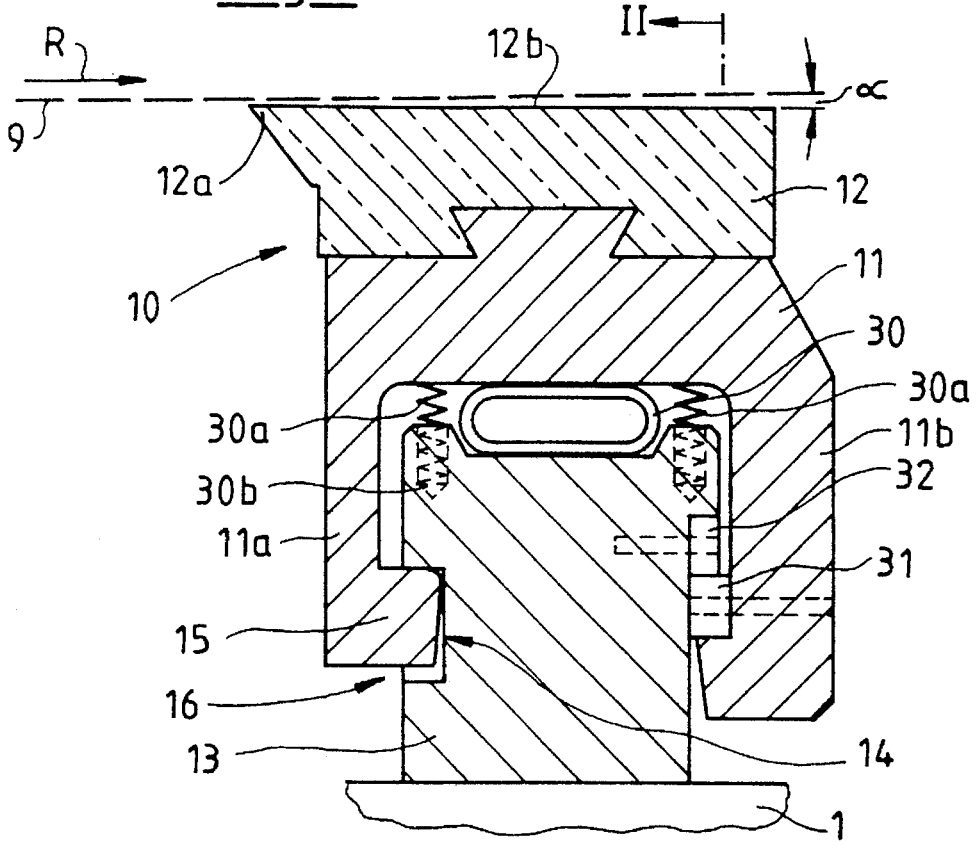
FIG. 1 illustrates an embodiment of an angularly adjustable drainage foil in cross section.
Figure 2:
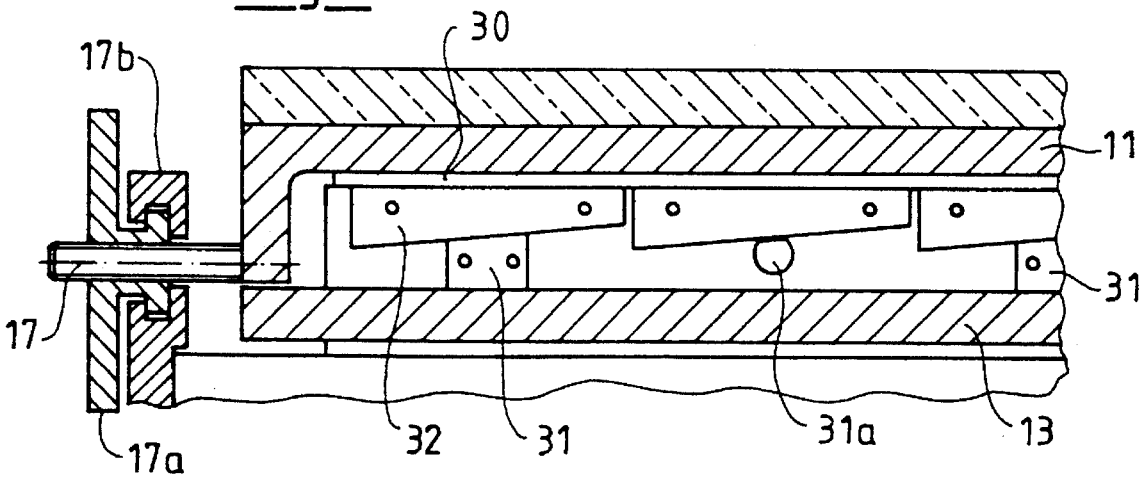
FIG. 2 illustrates a longitudinal section of the device relative to FIG. 1.

The stationary support illustrated in FIG. 1 and 2 has a movable support/foil shape referenced 10 overall and extending transverse to the direction of travel (arrow R) of wire 9. The cover strip 10 is composed, e.g., of a movable support shape 11 and, arranged on it, a foil strip 12 made of a hard material. The foil strip 12 has front section **12*a* (with a scraper-like front edge) touching the wire 9 (preferably on the underside of the wire) and, bordering on it, drainage surface 12*b* which with the travel direction R of the wire describes a small, variable angle of inclination $\alpha$. According to FIG. 1, the entire drainage surface 12*b* lies in a single plane, although a customary variation thereof is permissible. As illustrated, the travel direction R of wire 9** is approximately horizontal; but it may also be inclined or vertical. The assembly position of the support device is adapted to the respective travel direction of the wire.

The support shape 11 forming part of the cover strip 10 has an approximately U-shaped cross section. Located between shanks **11*a*, 11*b* of the support shape 11 is a stationary backing shape 13 which is rigidly joined to a beam 1. Provided in the front side face of backing shape 13 is a groove 14 which accommodates a tongue 15 formed on the front shank 11*a* of support shape 11, resulting in a tongue-and-groove joint 16. Viewed in cross section, the tongue 15 extends into groove 14** approximately parallel to the direction of wire travel.

A wide shoulder is provided on the rear side surface of backing shape 13 on which bear several serially arranged wedge-shaped parts 32. Correspondingly, a mirror-inverted shoulder is provided on shank **11*b*, with wedge-shaped parts 31, in turn, bearing on said shoulder and having their inclined plane (extending parallel to wedge-shaped parts 32**) on their top side. Both the approach-side and the departure-side claw-like members are pairwise provided with a plurality of paired members having complementary inclined surfaces, the approach-side inclines having an inclination less than the inclination of the departure-side inclines. The paired members having inclined surfaces may be exchanged by other paired members having complementary inclined surfaces of different angles of inclination.

To enable the support shape 11 to move relative to the backing shape 13, the length of wedge-shaped parts 31 is considerably shorter than that of wedge-shaped parts 32. Instead of wedge-shaped parts 31, flattened bolts 31*a* or the like, retained in shank 11*b* may also be provided.

The wedge-shaped parts 32 are fastened to the support shape 11, and wedge-shaped parts 31 to backing shape 13, with screws or pins.

Provided between the top side of the backing shape and the underside of the support shape is a compression device in the form of an interposed hose 30 to which internal pressure is supplied, or in the form of spring elements 30*a* in recesses 30*b*, the respective hose or spring elements ensuring that the matching surfaces of wedge-shaped parts 31,32 will extend on each other without play. Moving the support shape 11 relative to the backing shape 13 causes the back side of the support shape to be raised or lowered, respectively.

As shown in FIG. 2, the support shape 11 may be moved longitudinally, for instance, by means of a lead screw 17 and a rotatable drive disk 17*a* fixed axially in an axial bearing 17*b*. The drive disk 17*a* can in case of need be turned manually or by means of a not illustrated motor. An electric controller may be used for control of the motor, for example in a way such that a moving of the rod may be triggered, e.g., automatically based on measuring signals of any kind.

Figure 3:
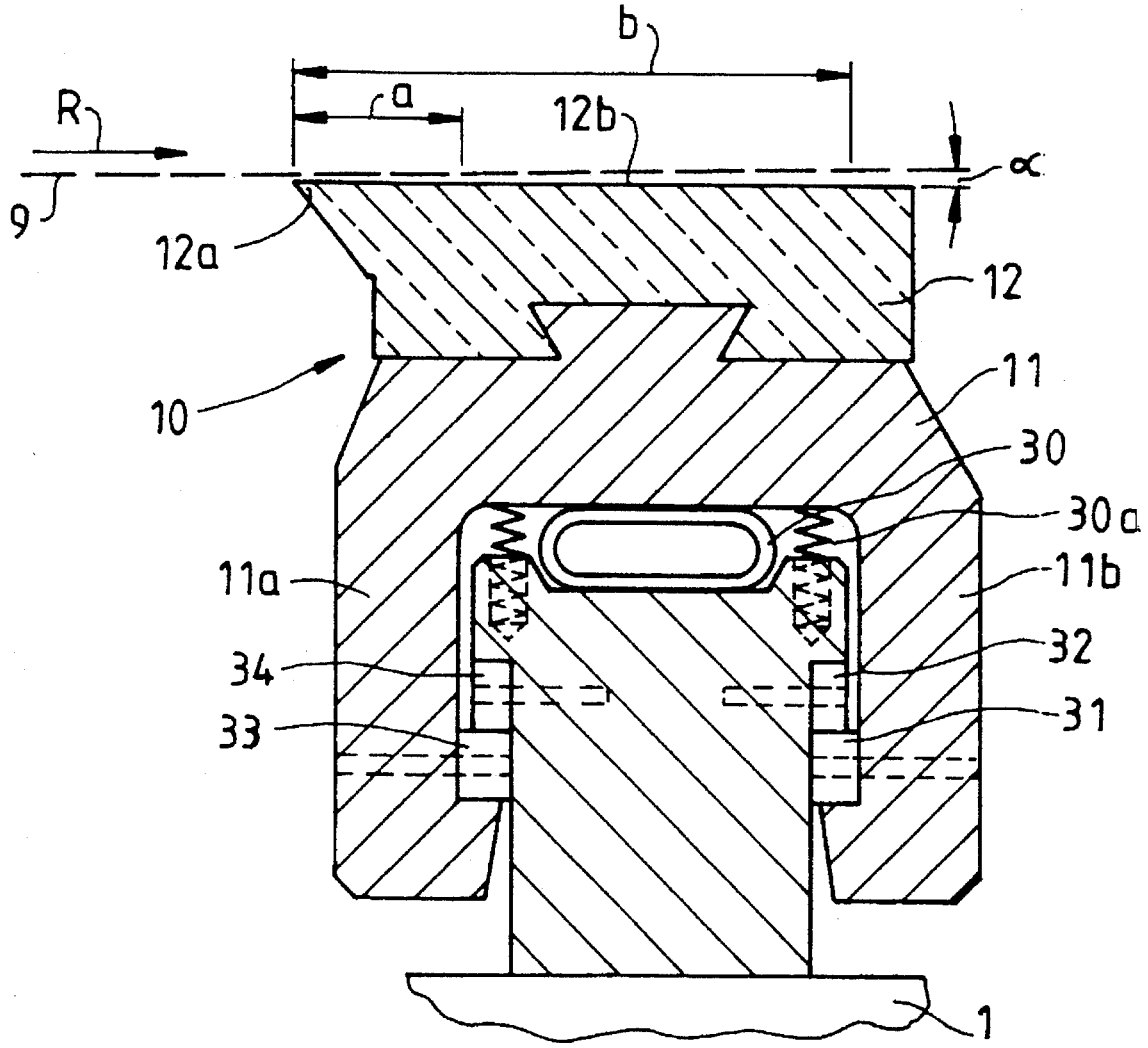
FIG. 3 illustrates a cross section of an embodiment of the drainage foil with two-sided height influencing.

FIG. 3 shows an embodiment of the drainage foil with two-sided influencing of the height, in cross section. FIG. 3 corresponds essentially to FIG. 1, with matching features referenced identically. The two embodiments differ in that the tongue-and-groove joint 16 in FIG. 1 is substituted in FIG. 3 by matching inclines in the form of attached wedge-shaped parts 34 and 33 equivalent to wedge-shaped parts 31 and 32. This embodiment enables by selection of the incline Sa of wedge-shaped parts 33, 34 and incline Sb of wedge-shaped parts 31, 32 at a ratio Sa/Sb~a/b—with "a" being the distance of the approach-side edge 12*a* of the cover strip from the approach-side wedges 33, 34 as projected on the wire surface, and "b" the distance of the approach-side edge 12*a* of the cover strip from the departure-side wedges 31, 32 as projected on the wire surface—an influencing of the cover strip 10, as it is moved, to the effect that the approach-side edge 12*a* remains constant in its height position and, thus, is not forced on the wire with greater or lesser intensity.

To minimize wire wear, the wire must not be backed by a sharp edge. Therefore, a preferably slightly cylindrical, curved wire backing surface of width 2× is provided in the area of the edge and slopes from the stripping edge up to the surface of cover 12 downward by the angle α. With such backing surface, Sa/Sb~(a-x)/(b-x) instead of Sa/Sb~a/b, when backing is provided directly at the edge, which is allowed, e.g., with soft cover material. Preferably "x" has a value of 0–10 mm.

The same effect described in FIG. 3 is achievable when forcing a simultaneous height change of the approach and departure sides of the cover strip at the respective ratio a/b by orienting the two sides with the aid of slanted slots and cams engaging them. The combination of slanted slots, on the one hand, and cams movable in them, on the other hand, may be provided instead of the nonpositive inclines; and a plain U-shaped wrap-around of the support structure by the cover strip may be provided instead of the claw type engagement.

What is claimed is:

1. An angularly adjustable drainage foil for a revolving dewatering wire of a paper machine, comprising:

a facultatively two-part support structure extending across the width of the machine, said two-part support structure comprising a first beam and a backing shape mounted on said beam, said support structure having a top side, an approach-side backing surface and a departure-side backing surface;

a facultatively two-part cover strip extending across the width of the machine, said two-part cover strip having an underside and having claw-like members, one of said claw-like members being configured and arranged for engaging said approach-side backing surface and another of said claw-like members being configured and arranged for engaging said departure-side backing surface, said cover strip further comprising an upper, wear-resistant foil strip and a support shape supporting said foil strip, said foil strip having a drainage surface;

a moving device for effecting a relative longitudinal motion between said cover strip and said support structure;

means for influencing an angle of incidence α between said drainage surface and a surface of said wire running over said drainage surface, upon relative movement between said cover strip and support structure; and compression means between said underside of the cover strip and said top side of the support structure for forcing said claw-like members and said backing surfaces into said engagement;

said cover strip being configured such that it grips the backing shape in claw-like fashion, and wherein the approach-side claw-like engagement of the support structure by the cover strip comprises a joint parallel with the longitudinal axis; and the departure-side claw-like engagement of the support structure by the cover strip on the side of the cover strip and on the side of the support structure includes a plurality of paired, inclines.

2. The device of claim 1, in which the approach-side backing surface has an edge having a height position, wherein each of said claw-like members includes means which, as the cover strip is moved, effect a simultaneous height change of front and back side of the cover strip, said height position of the approach-side edge remaining generally constant.

3. The device of claim 2, wherein both the approach-side and the departure-side claw-like members are pairwise provided with a plurality of inclines; the approach-side inclines having an inclination less than the inclination of the departure-side inclines.

4. The device of claim 3, wherein the inclination of the approach-side inclines (Sa) and departure-side inclines (Sb) relate to each other as Sa: Sb~a:b, with "a" being the distance of the approach-side edge of the cover strip from the approach-side inclines as projected on the wire surface, and "b" the distance of the approach-side edge of the cover strip from the departure-side inclines as projected on the wire surface.

5. The device according to claim 3, wherein the inclination of the approach-side inclines (Sa) and departure-side inclines (Sb) relate to each other as Sa:Sb~(a-x): (b-x), with a being the distance of the approach-side edge of the cover strip from the approach-side incline as projected on the wire surface, "b" being the distance of he approach-side edge of the cover strip from the departure-side incline as projected on the wire surface, and where "x" has a value of 0–10 mm.

6. The device of claim 1, wherein the inclines comprise exchangeable wedges.

7. The device of claim 3, wherein the inclines comprise exchangeable wedges.

8. An angularly adjustable drainage foil for a revolving dewatering wire of a paper machine, comprising:

a facultatively two-part support structure extending across the width of the machine, said two-part support structure comprising a first beam and a backing shape mounted on said beam, said support structure having a top side, an approach-side backing surface and a departure-side backing surface;

a facultatively two-part cover strip extending across the width of the machine, said two-part cover strip having an underside and having claw-like members, one of said claw-like members being configured and arranged for engaging said approach-side backing surface in claw-like fashion and another of said claw-like members being configured and arranged for engaging said departure-side backing surface in claw-like fashion, wherein both the approach-side and the departure-side claw-like members are pairwise provided with a plurality of inclined surfaces, the approach-side inclined surfaces having an inclination less than the inclination of the departure-side inclined surfaces, said cover strip further comprising an upper, wear-resistant foil strip and a support shape supporting said foil strip, said foil strip having a drainage surface;

a moving device for effecting a relative longitudinal motion between said cover strip and said support structure;

means for influencing an angle of incidence $\alpha$ between said drainage surface and a surface of said wire running over said drainage surface, upon relative movement between said cover strip and support structure; and compression means between said underside of the cover strip and said top side of the support structure for forcing said claw-like members and said backing surfaces into said engagement.

9. The device of claim 8, wherein the inclined surfaces comprise exchangeable wedges.

* * * * *